US005122231A

United States Patent [19]

Anderson

[11] Patent Number: 5,122,231

[45] Date of Patent: Jun. 16, 1992

[54] CATIONIC CROSS-LINKED STARCH FOR WET-END USE IN PAPERMAKING

[75] Inventor: Kevin R. Anderson, Cedar Rapids, Iowa

[73] Assignee: Cargill, Incorporated, Minneapolis, Minn.

[21] Appl. No.: 534,945

[22] Filed: Jun. 8, 1990

[51] Int. Cl.[5] ..... D21H 17/29

[52] U.S. Cl. ..... 162/175; 162/183

[58] Field of Search ..... 162/175, 183; 536/106

[56] References Cited

U.S. PATENT DOCUMENTS

| | | | |
|---|---|---|---|
| 2,813,093 | 11/1957 | Caldwell et al. | 260/233.3 |
| 2,970,140 | 1/1961 | Hullinger et al. | 260/233.3 |
| 3,067,088 | 12/1962 | Hofreiter et al. | 162/175 |
| 3,070,452 | 12/1962 | Harris et al. | 106/213 |
| 3,070,594 | 12/1962 | Harris et al. | 260/233.3 |
| 3,087,852 | 4/1963 | Hofreiter et al. | 162/175 |
| 3,160,552 | 12/1964 | Russell et al. | 162/146 |
| 3,219,518 | 11/1965 | Barber et al. | 162/175 |
| 3,219,519 | 11/1965 | Barber et al. | 162/175 |
| 3,320,066 | 5/1967 | Garth | 96/85 |
| 3,346,563 | 10/1967 | Shildneck et al. | 260/233.3 |
| 3,378,547 | 4/1968 | Patel et al. | 260/233.3 |
| 3,448,101 | 6/1969 | Billy et al. | 260/233.3 |
| 3,459,632 | 8/1969 | Caldwell et al. | 162/175 |
| 3,467,608 | 9/1969 | Dishburger et al. | 260/9 |
| 3,467,647 | 9/1969 | Benninga | 260/209 |
| 3,562,103 | 2/1971 | Moser et al. | 162/175 |
| 3,649,624 | 3/1972 | Powers et al. | 260/233.3 R |
| 3,666,751 | 5/1972 | Jarowenko et al. | 260/233.3 R |
| 3,737,370 | 5/1973 | Jarowenko et al. | 162/175 |
| 3,770,472 | 11/1973 | Jarowenko | 106/213 |
| 3,778,431 | 12/1973 | Kightlinger et al. | 536/106 |
| 3,802,959 | 4/1974 | Francis et al. | 162/175 |
| 3,834,984 | 9/1974 | Wing et al. | 162/175 |
| 3,912,715 | 10/1975 | Jarowenko | 260/233.3 R |
| 4,029,544 | 6/1977 | Jarowenko et al. | 162/175 |
| 4,048,435 | 9/1977 | Rutenberg et al. | 536/106 |
| 4,093,510 | 6/1978 | Carr | 162/175 |
| 4,127,563 | 11/1978 | Rankin et al. | 536/50 |
| 4,152,199 | 5/1979 | Hamerstrand et al. | 162/164 R |
| 4,167,621 | 9/1979 | Tessler | 536/108 |
| 4,210,490 | 7/1980 | Taylor | 162/175 |
| 4,212,704 | 7/1980 | Durand et al. | 162/175 |
| 4,216,310 | 8/1980 | Wurzburg et al. | 536/108 |
| 4,260,738 | 4/1981 | Tessler | 536/49 |
| 4,278,573 | 7/1981 | Tessler | 260/17.4 GC |
| 4,347,100 | 8/1982 | Brucato | 162/10 |
| 4,566,910 | 1/1986 | Hubbard et al. | 127/70 |
| 4,613,407 | 9/1986 | Huchett et al. | 162/175 |
| 4,632,984 | 12/1986 | Matsunaga et al. | 536/50 |
| 4,665,014 | 5/1987 | Katsura | 430/538 |
| 4,741,804 | 5/1988 | Solarek et al. | 162/175 |
| 4,750,974 | 6/1988 | Johnson | 162/164 |
| 4,810,785 | 3/1989 | Johnson | 536/106 |
| 4,818,341 | 4/1989 | Degen et al. | 162/168 |
| 4,824,523 | 4/1989 | Wagberg et al. | 162/164 |
| 4,840,705 | 6/1989 | Ikeda et al. | 162/175 |
| 4,849,055 | 7/1989 | Yoshioka et al. | 162/158 |
| 4,872,951 | 10/1989 | Maliczyszyn et al. | 162/35 |

FOREIGN PATENT DOCUMENTS

| | | | |
|---|---|---|---|
| 97371 | 1/1984 | European Pat. Off. | 162/175 |

OTHER PUBLICATIONS

Casey, *Pulp and Paper*, 3rd ed. (1981) vol. III, p. 1599.

*Primary Examiner*—Peter Chin

*Attorney, Agent, or Firm*—Fitch, Even, Tabin & Flannery

[57] ABSTRACT

A new cationized subsequently cross-linked starch is described in connection with improved method of paper making in the wet-end system of a paper machine utilizing a Neutral or Alkaline furnish.

14 Claims, 5 Drawing Sheets

CATIONIC CROSS-LINKED STARCH FOR WET-END USE IN PAPERMAKING

This invention relates to cationic cross-linked starches and to the use of those starches in papermaking. More particularly, the present invention is directed to cationization and cross-linking of starch, and the use of that cationized cross-linked starch in the wet end system of a paper machine.

The cationized cross-linked starch of the invention is particularly adapted for use in the wet-end system of a paper machine and more particularly in the furnish. The wet-end of the paper machine is where paper fiber in a dilute water slurry of pulp fiber is combined with a variety of materials, including starches, to provide various paper properties or characteristics as the aqueous slurry is distributed onto a paper machine wire, as in a Fourdrinier machine. Three types of paper processes are known, and are referred to as "Acid", "Neutral" or "Alkaline", which correspond generally to the pH of the furnish. Acid furnishes generally have a pH of less than 6.0 while Neutral furnishes have a pH between about 6.5 and 7.5. Alkaline furnishes have a pH above 7.5. Acid, Neutral and Alkaline processes also differ in their make-up, which can affect the performance of additives such as cationic starches. Acid processes have been primarily used in paper manufacture, but Neutral and Alkaline processes are on the increase in the manufacture of paper.

Starches modified in various ways have been used in papermaking to improve paper characteristics. Starches modified to be cationic are known to aid in the retention of fines, adsorb onto the anionic cellulosic fibers to improve pigment binding efficiency, and improve the dry strength of the resulting paper. However, as is more fully described below, over cationization of the pulp or paper furnish results in poor sheet formation and poor drainage of the furnish on the paper machine.

Starch Loading is a term used hereafter to describe the amount of cationic starch added to a paper furnish to improve the parameters of drainage, retention and strength properties, and is usually expressed in units of pounds of starch per ton of paper fiber on a weight to weight basis. Paper furnish or pulp is anionic (negatively charged), and it can adsorb only as many cationic (positive) charges from the starch as there are available anionic charges. Near the isoelectric point, i.e., where the charges are balanced, optimum drainage, retention, and sheet formation of paper should occur. Over cationization of the furnish results in loss of drainage and poor sheet formation. Cationic starch is important to paper manufacturing plants that use high amounts of fillers such as clays and calcium carbonate ($CaCO_3$) in the paper stock. High filler amounts have been shown to be detrimental to wet and dry paper strength. Cationic starch addition to the furnish is used to counteract the loss of wet and dry strength of high filler paper.

Drainage (or de-watering ability) is a critical parameter in paper manufacture because it is directly related to how fast the paper machine can run; the greater the speed, the higher the production rate. Yet, it is a parameter that has largely been ignored with respect to starch. The value of heavy starch loading has not been appreciated nor practiced in the paper industry. Further, the utilization of such heavy starch loading while enjoying rapid drainage has not been attainable.

It is a particular object of this invention to provide a new cationic starch particularly useful in paper manufacture.

It is another object of this invention to provide a new method of papermaking utilizing heavy starch loading in paper manufacture.

It is also an object of this invention to provide improved drainage in order to increase the speed of paper manufacture with heavy loading of starch.

It is another object of this invention to improve the drainage of furnish in a paper machine as well as increase starch loading, yet also enhance the retention of fines and fillers of the paper furnish.

It is also an object of this invention to improve the drainage and retention properties of the furnish in a paper machine as well as increased starch loading, yet also enhance the wet and dry properties of the resulting paper.

Still further objects and advantages of the invention will be found by reference to the following description.

SUMMARY OF THE INVENTION

According to the invention, a cationic starch which has been cross-linked after cationization is added to anionic paper pulp or furnish during paper manufacture. The starch of the invention is added to achieve a near zero Zeta potential and to balance the charges in the furnish. Thus, when the anionic charges of the fibers are high, higher levels of starch may be added but, in any event, over cationization is to be avoided, as before pointed out. Adding the cationized cross-linked starch permits starch loading up to about 50 pounds of starch per ton of fiber, permits drainage increases in a range of from about 10 to about 20-fold, as measured by a Dynamic Drainage Jar and enhances the wet and dry strength and other properties of the paper which includes the cationic cross-linked starch. According to the invention, the viscosity of cationized cross-linked starch which is in the range of from about 500 cps to about 3000 cps, as measured on a Brookfield viscometer, at 1.4 percent starch solids at 95° C., at 20 rpm, using a number 21 spindle, results in the enhancement of drainage of the furnish.

The cationization and subsequent cross-linking of the starch which is added in paper manufacture is important to the invention. The starch is cationized to a degree of substitution (DS) of greater than 0.005, but not greater than 0.050, preferably to a DS of from about 0.030 to about 0.040. Thereafter, the cationized starch is cross-linked with a cross-linker which may be a polyfunctional organic or inorganic compound wherein functional groups, such as epoxides or anhydrides, on the cross-linker are reactive with hydroxyl groups on the starch. The degree of substitution (DS) is defined as the average number of hydroxyl groups on each anhydroglucose unit which are derivatized with substituent groups and is described generally in *STARCH: Chemistry and Technology*, second edition, R. L. Whister, J. N. Bemiller, and E. F. Paschall, editors, Academic Press, Inc., 1984. The DS serves as a measure of the charge on the cationized and cross-linked starch and is related to the average number of monovalent cations on the hydroxyl groups on each anhydroglucose unit.

While not intending to be bound by any theory of the invention, it is believed cationization with subsequent cross-linking of the starch encloses some of the cationically charged portions or branches of the starch as well as increases the molecular weight, and therefore the hydrodynamic volume, of the starch. The enclosure of some of the portions of the cationically charged starch enhances the starch loading of the starch into the paper; the cross-linking, however, also builds the molecular weight (hydrodynamic volume) of the starch polymer which will enhance the de-watering ability of the starch to permit increase in the speed of the papermaking process. The increase in size of the starch polymer aids in bridging the fines and fillers of the paper furnish, resulting in enhancement of retention and drainage. Furthermore, the cationized and cross-linked starch enhances other paper properties as demonstrated hereinafter.

The term "paper" refers generally to fibrous cellulosic materials, as well as fibers from synthetics such as polyamides, polyesters, and polyacrylic resins, mineral fibers such as asbestos and glass, and combinations of fibers.

DESCRIPTION OF THE PREFERRED EMBODIMENT

Figure 1:
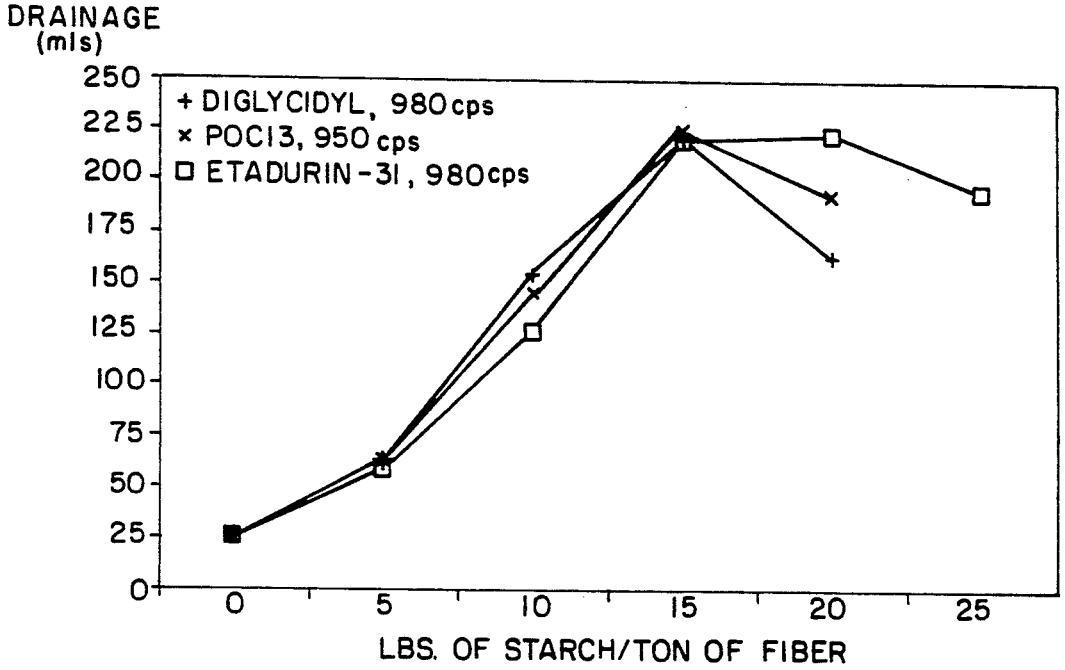
FIG. 1 shows the effect on drainage of an alkaline furnish using 3 different crosslinking agents for the cationic starch.

According to the preferred practice of the invention, starch is cationized to a degree of substitution (DS) of from about 0.030 to about 0.040. The starch may be cationized by any known method such as by reacting starch in an alkaline medium with tertiary or quaternary amines followed by neutralization, and washing and drying as desired. Known methods for cationizing starch are described in U.S. Pat. Nos. 4,146,515 to Buikema et al. and 4,840,705 to Ikeda et al. In one important aspect of the invention, cornstarch is cationized by reaction of the starch with (3-chloro-2-hydroxypropyl) trimethyl ammonium chloride in an alkaline medium provided by sodium hydroxide to form the cationic (2-hydroxypropyl) trimethyl ammonium chloride starch ether with a molar degree of substitution (DS) of the ether on the starch in the range of from about 0.030 to about 0.040.

The starch used of the invention may be from a variety of sources such as corn, waxy maize, potato, rice, wheat, sorghum, and the like. The starch must have hydroxyl or another functional group to permit it to be cross-linked. This invention can utilize cationic starch regardless of its method of preparation. Some cationic starches, however, have a positive charge in acidic environments, due to protonation of a substituent, such as protonation of an amino nitrogen, but lose their positive charge under neutral or basic conditions. Other cationic starches carry a positive charge over the entire pH range, such as those having quaternary ammonium, quaternary phosphonium, tertiary sulfonium, or other substituents. It is preferred to use a cationic starch which retains a positive charge that has been derivatized to contain a quaternary ammonium ion because of enhanced flexibility in pH. Frequently, such quaternary ammonium-containing starch has been derivatized by etherification of hydroxyl groups with an appropriate etherifying agent having a cationic character such as (3-chloro-2 hydroxypropyl) trimethyl ammonium chloride, the methyl chloride quaternary salt of N-(2,3-epoxypropyl) dimethylamine or N-(2,3-epoxypropyl) dibutylamine or N-(2,3-epoxypropyl)methylaniline.

After cationization, the starch is cross-linked with a cross-linker which is reactive with the hydroxyl functionality of the starch. The starch may be cross-linked with polyepoxide compounds such as a polyaminepolyepoxide resin (which is a reaction product of 1,2-dichloroethane and epichlorohydrin), phosphrousoxychloride, 1,4 butanediol diglycidyl ether, dianhydrides, acetals and polyfunctional silanes. These and other suitable cross-linkers are described in U.S. Pat. Nos. 3,790,829; 3,391,018; and 3,361,590. The molecular weight of cross-linked starch is not only difficult to measure, but molecular weight determinations in starches are subject to general ambiguity due to the lack of adequate standards for Gel Permeation Chromotography (GPC), and the difficulty in Laser Light Scattering techniques. It is known, however, that the molecular weight of starch, including cross-linked starch, has a high correlation to the viscosity of the starch; the more viscous the starch the higher the molecular weight. The cationic cross-linked starch is cross-linked to a viscosity in the range of from about 500 cps to about 3000 cps, preferably from about 500 cps to about 1500 cps as measured on a Brookfield viscometer using as 1.0 Be Slurry (at 21° C.) to obtain a 1.4 percent solids, measuring hot paste viscosity (95° C.) after a period of 10 minutes, at 20 rpm (No. 21 spindle). The amount of cross-linker used is a function of the time and kind of cross-linker, as well as reaction conditions, all of which are chosen to provide the viscosity in the specified range.

The cationic cross-linked starch of the invention may be mixed into a paper furnish having a pH of from 6.0 to about 9.0 as a wet-end additive. The general manufacturing process for paper, including the term "wet-end", is well-known to those skilled in the art and described generally in *Pulp & Paper Manufacture,* Vol. III, Papermaking and Paperboard Making, R. G. McDonald, editor: J. N. Franklin, Tech. Editor, McGraw Hill Book Co., 1970. The furnish may include hardwood, softwood or a hardwood/softwood blend. Addition of the cationic cross-linked starch may occur at any point in the papermaking process; i.e. prior to conversion of the wet pulp into a dry web or sheet. Thus, for example, it may be added to the fiber while the latter is in the headbox, beater, hydropulper, or stock chest. The furnish may include additives, dyes, and/or fillers such as clays, $CaCO_3$, alum and the like. Indeed, the invention advantageously permits the use of higher levels of starch and fillers in lieu of more expensive cellulosic fiber, the result being paper with enhanced strength made with less expensive raw materials in shorter process times with higher retention of fines and fillers.

Typically cationic corn, potato, and waxy maize starches substituted to a DS in the range of 0.030 to 0.040, exhibit peak or maximum drainage rates at about 5 to about 15 pounds of starch per ton of paper fiber. In accord with the invention, starch loading of cationic cross-linked cornstarch of similar DS having a viscosity of about 1000 cps (1.0 Be slurry, 95° C. hot paste) provides peak drainage increases of 30 percent to 50 percent over cationic corn or potato starches, at about 20 to about 40 pounds of starch per ton of paper fiber, giving starch loading improvements of about 100% to 400%. While the cationic cross-linked starch of the invention improves certain paper properties at lower starch loading levels, the benefits of the invention are most enjoyed at starch loadings of 20 to 40 pounds per ton of fiber, provided that over cationization is avoided.

The following Examples set forth exemplary methods for making the cationic cross-linked starch of the invention and practicing the method of the invention in a papermaking process.

EXAMPLE I 4000g of cornstarch in an aqueous slurry is reacted with 430 g of 65% (3-chloro-2-hydroxypropyl) trimethyl ammonium chloride and 1 liter of 8% aqueous sodium hydroxide in a saturated salt solution at 45° C. for 18 hours at 15 ml alkalinity titer (10 ml sample, 0.1N $H_2SO_4$). The cationized starch has a DS of 0.032. 2.0 g of a 20% aqueous solution of Etadurin-31 from Akzo Chemie America, a polyaminopolyepoxide polymer, (0.01% by weight addition, based upon the weight of the starch) is added to cross-link the cationized starch. After 1 hour at 45° C., a 100 ml aliquot is removed and neutralized with hydrochloric acid to a pH of 4.0, and the slurry is filtered, and the resultant cake washed with water. A portion of the washed cake is then re-suspended in water to a Be of 1.0 at 21° C., heated at 95° C. for 10 minutes, and the viscosity measured on a Brookfield viscometer at 20 rpm. When the hot paste (95° C.) viscosity of the samples prepared in this manner approach 1000 cps, the reaction mixture is neutralized to a pH of 4.0 with hydrochloric acid and the suspension filtered, washed with water, and dried to about 10% moisture.

PERFORMANCE OF THE CATIONIZED CROSS-LINKED STARCH OF EXAMPLE I

(a) Drainage

A paper stock is prepared by adding 114 g of a 50:50 blend of hardwood/softwood bleached paper fiber, re-suspended in water using a Waring blender, 2.85 g clay (50#/ton fiber) and 2.85 g precipitated calcium carbonate ($CaCO_3$) as fillers to 37.85 1 (10.0 gallons) of water pH adjusted to pH 7.5. Drainage evaluations are performed by measuring the volume of filtrate through a standard qualitative filter paper for a period of 1 minute, the results of which are shown in Table I. One liter of the furnish is subjected to a constant shear rate from a 1000 rpm agitator during starch addition. Typical drainage enhancements using the cationized cross-linked starch of the invention versus cationic corn or cationic potato starches are in the range of 30 percent to 50 percent.

TABLE I (Commercial Drainage Results)
Standard Error of Prediction (SE) = 1.0%

| Pound starch/ Ton Fiber | Commercial Cationic Potato | Commercial Cationic Corn | Cationic Cross-linked |
|---|---|---|---|
| 0 | 20 ml | 20 ml | 20 ml |
| 5 | 77 ml | 34 ml | 25 ml |
| 10 | 178 ml | 126 ml | 35 ml |

TABLE I-continued (Commercial Drainage Results)
Standard Error of Prediction (SE) = 1.0%

| Pound starch/ Ton Fiber | Commercial Cationic Potato | Commercial Cationic Corn | Cationic Cross-linked |
|---|---|---|---|
| 15 | 154 ml | 180 ml | 67 ml |
| 20 | | 140 ml | 142 ml |
| 25 | | | 240 ml |
| 30 | | | 256 ml |
| 40 | | | 232 ml |
| 50 | | | 112 ml |

(b) Retention

Retention percentages of the paper furnish are measured in a manner similar to drainage. Retention is defined as the amount of fiber and filler retained in the paper sheet divided by the total fiber and filler in the paper furnish. A 70 mesh wire screen is substituted for the filter paper used in the drainage measurement, and the first 100 ml of filtrate is collected while the furnish is subjected to a constant 500 rpm agitator shear rate. An oven dry method is used to measure percent solids in the filtrate. The results of the tests, as shown in Table II below, show that retention improvements of the cationized cross-linked starch of Example I over cationic corn and cationic potato are typically in the range of 5% to 10% absolute retention.

TABLE II (Retention Percentage)
Standard Error of Prediction = 0.21

| Pound Starch/ Ton Fiber | Commercial Cationic Potato | Commercial Cationic Corn | Cationic Cross-linked |
|---|---|---|---|
| 0 | 75.2% | 75.2% | 75.2% |
| 5 | 77.3% | 77.4% | 76.7% |
| 10 | 78.2% | 78.2% | 76.9% |
| 15 | 80.8% | 78.0% | 78.4% |
| 20 | 80.6% | 78.5% | 80.4% |
| 25 | 80.9% | 81.4% | 82.3% |
| 30 | 79.6% | 79.4% | 84.9% |
| 40 | 81.3% | 79.2% | 85.3% |
| 50 | 79.4% | 77.5% | 87.3% |

EXAMPLE II

(Comparison of Cross-Linkers)

a) Phophorous oxychloride is used to cross-link cationized cornstarch (2-hydroxypropyl) trimethyl ammonium chloride starch ether, DS 0.028, by reacting 0.18 ml of the cross-linker with 1700 g of the cationized cornstarch at pH 10.0 at 45° C. for 15 minutes to a Brookfield hot paste (95° C.) viscosity of 950 cps.

b) 1,4-Butanediol diglycidyl ether is used to cross-link cationized cornstarch (2-hydroxypropyl) trimethyl ammonium chloride starch ether, DS 0.033, by reacting 1.5 ml of the cross-linker with 1700 g of the cationized cornstarch at 16.5 ml alkalinity titer (10 ml sample, 0.1N $H_2SO_4$) for 20 hours at 45° C. to a Brookfield hot paste (95° C.) viscosity of 980 cps.

c) A polyaminepolyepoxide resin (Etadurin-31) is used to cross-link cationized cornstarch (2-hydroxypropyl) trimethyl ammonium chloride starch ether, DS 0.032, as in Example I to a Brookfield hot paste (95° C.) viscosity of 980 cps.

DRAINAGE PERFORMANCE

The drainage performance of the cationic cross-linked starches described in (a), (b) and (c) above are tested by the method described in Example I using a furnish having 0.3% fiber, 50#/ton clay, and 50#/ton $CaCO_3$, at a pH of 7.5. The drainage performance of each cationic cross-linked starch is illustrated in FIG. 1. These results show approximately the same peak drainage for each of the cross-linkers, with the starch cross-linked with the polyaminepolyepoxide resin (Etadurin-31) showing a slightly better starch loading ability.

EXAMPLE III (Effects of Varying Cationization)

The following cornstarches are cationized (2-hydroxypropyl) trimethyl ammonium chloride with the DS of the quaternary ammonium group being varied as follows:

| Cationized Cornstarch | DS |
|---|---|
| X42 | 0.032 |
| X82 (Series) | 0.020 |

The above starches are cross-linked as shown below with polyaminepolyepoxide resin (Etadurin-31) to the indicated hot paste (95° C.) viscosities which correlate with the degree of cross-linking.

| Cationic Cross-linked Cornstarch | Brookfield Viscosity |
|---|---|
| X82 (not cross-linked) | 395 cps |
| X82A | 540 cps |
| X82B | 690 cps |
| X82C | 980 cps |
| X82D | 1100 cps |
| X42B3 | 980 cps |

Figure 2:
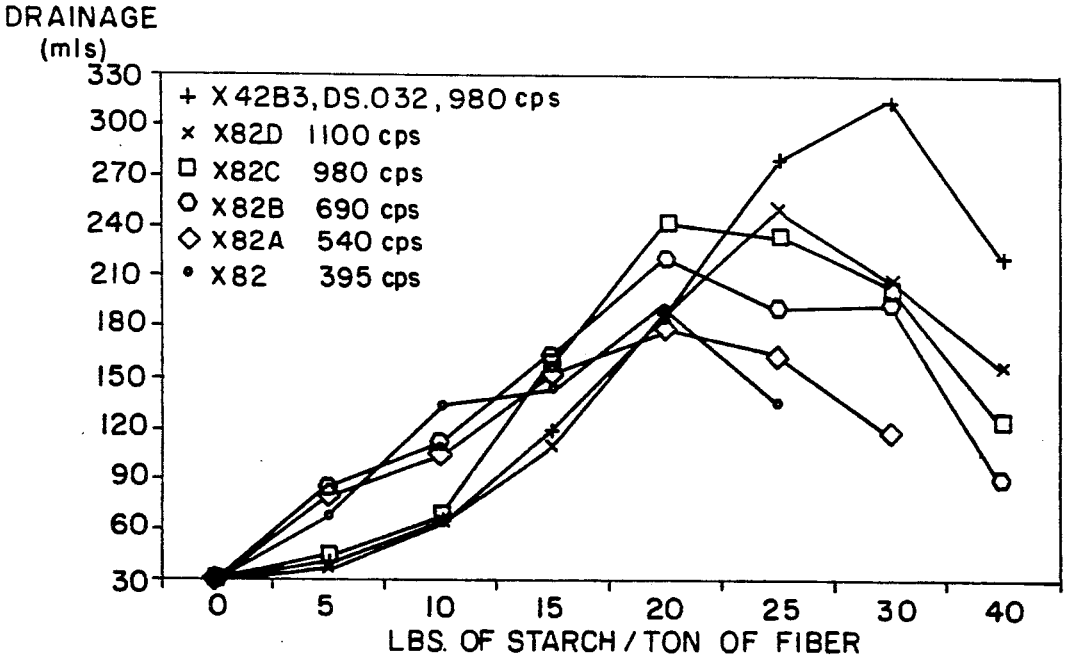
FIG. 2 shows the effect on drainage of an alkaline furnish using varying cationization of the crosslinked starch.

The drainage performance of each of the above cationized cross-linked starches was tested as described in Example I using the standard laboratory furnish having 0.3% fiber, 50#/ton clay, 50#/ton $CaCO_3$, the furnish having a pH of 7.5. The effect upon drainage of each cross-linked starch is illustrated in FIG. 2. These data indicate that a lower molecular substitution of cationic material onto the starch adversely affects drainage on this furnish.

EXAMPLE IV (Comparison of Starches)

Corn, potato and waxy maize starches are cationized with a quaternary ammonium group ((2-hydroxypropyl) trimethyl ammonium chloride) to a DS of 0.035, and cross-linked with the polyaminepolyepoxide resin to Brookfield viscosities, for time of cross-linking reaction indicated below.

TABLE III

| Starch | Designation | |
|---|---|---|
| | | Hours of Cross-linking |
| Potato | X80 (not cross-linked) | 0.0 |
| Potato | X80A | 0.5 |
| Potato | X80B | 1.0 |
| Potato | X80C | 2.0 |
| Potato | X80D | 3.0 |
| Potato | X80E | 5.0 |
| | | Brookfield Viscosity |
| Waxy | X77 (not cross-linked) | 1640 cps |
| Waxy | X77A | 2640 cps |
| Waxy | X77B | 2950 cps |
| Waxy | X77C | 2970 cps |
| Corn | $X42B_3$ | 980 cps |

TABLE III-continued

| Starch | Designation | |
|---|---|---|
| Corn | $X42B_4$ | 1170 cps |

Figure 3:
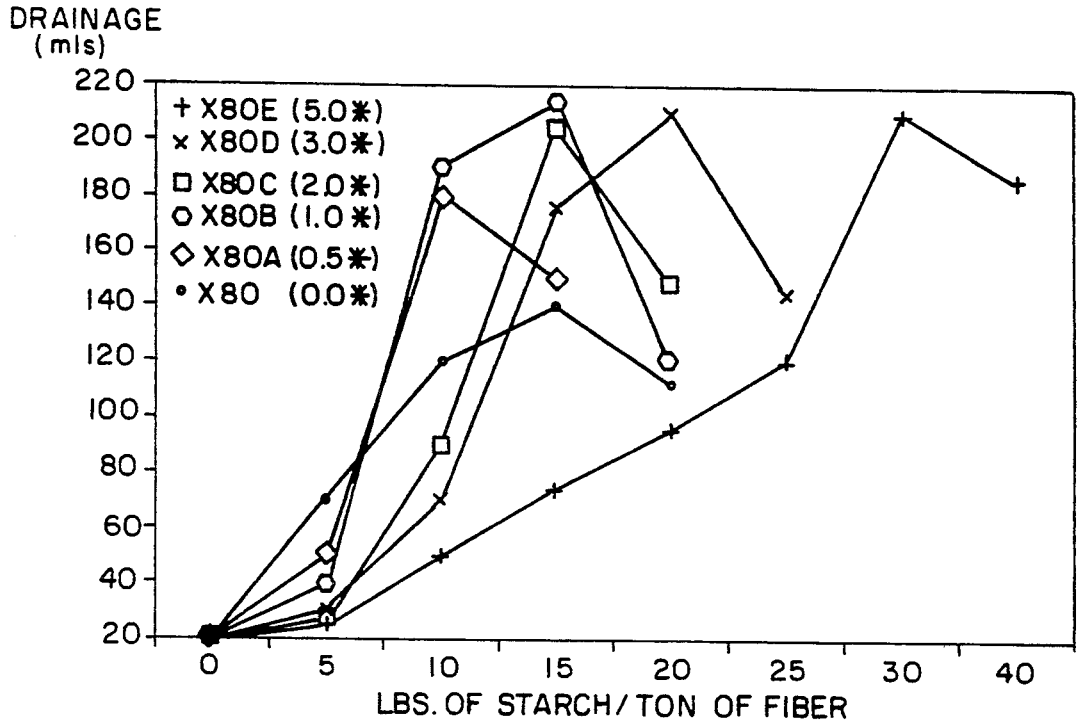
FIG. 3 shows the effect on drainage of an alkaline furnish using cationic crosslinked potato starch.
Figure 4:
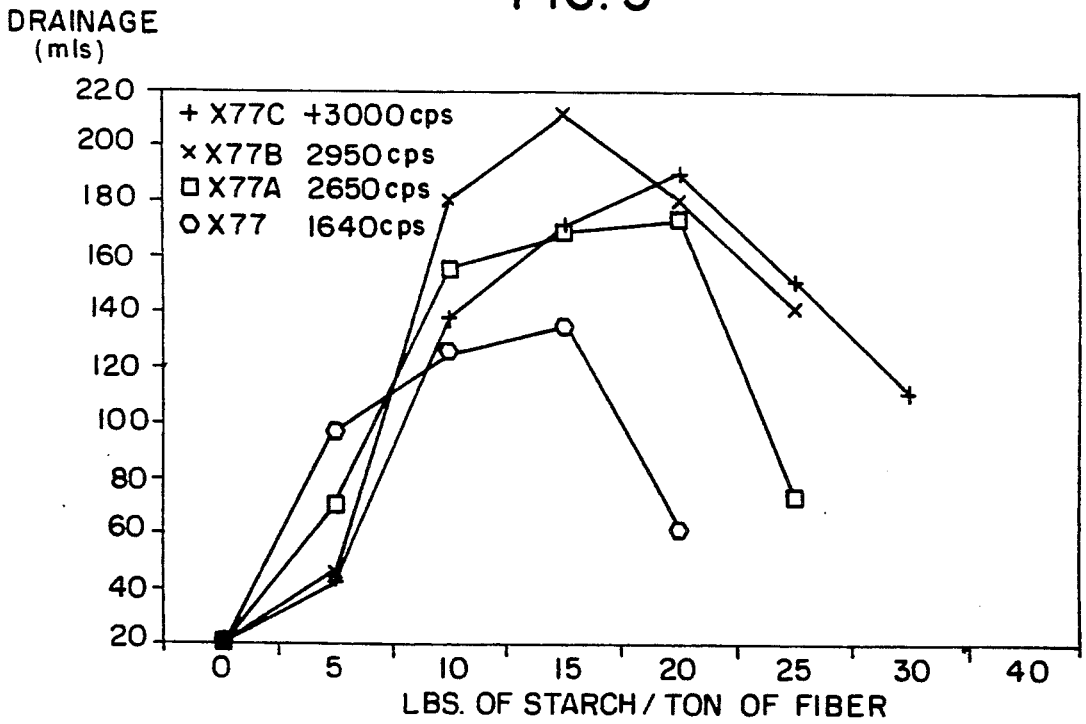
FIG. 4 shows the effect on drainage of an alkaline furnish using cationic crosslinked waxy maize starch.

The drainage for the above waxy maize and potato starches in the furnish described in Example I was performed and the results are illustrated in FIGS. 3 and 4.

Figure 5:
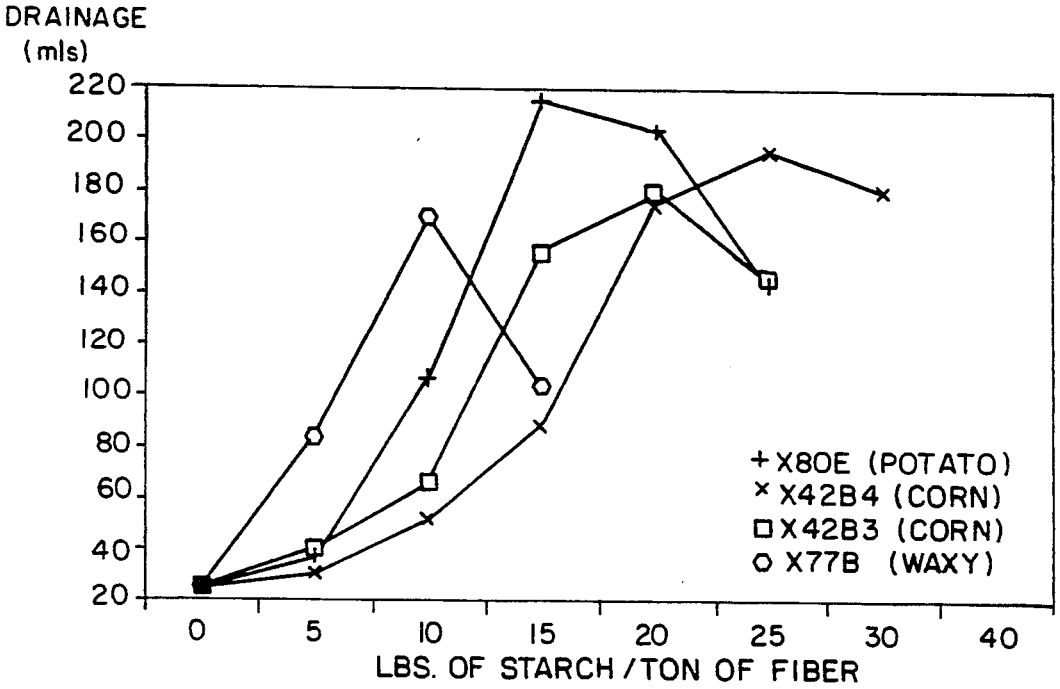
FIG. 5 is a comparison of cationic cross-linked corn, waxy maize and potato starches and the effect on drainage of an alkaline furnish.
Figure 6:
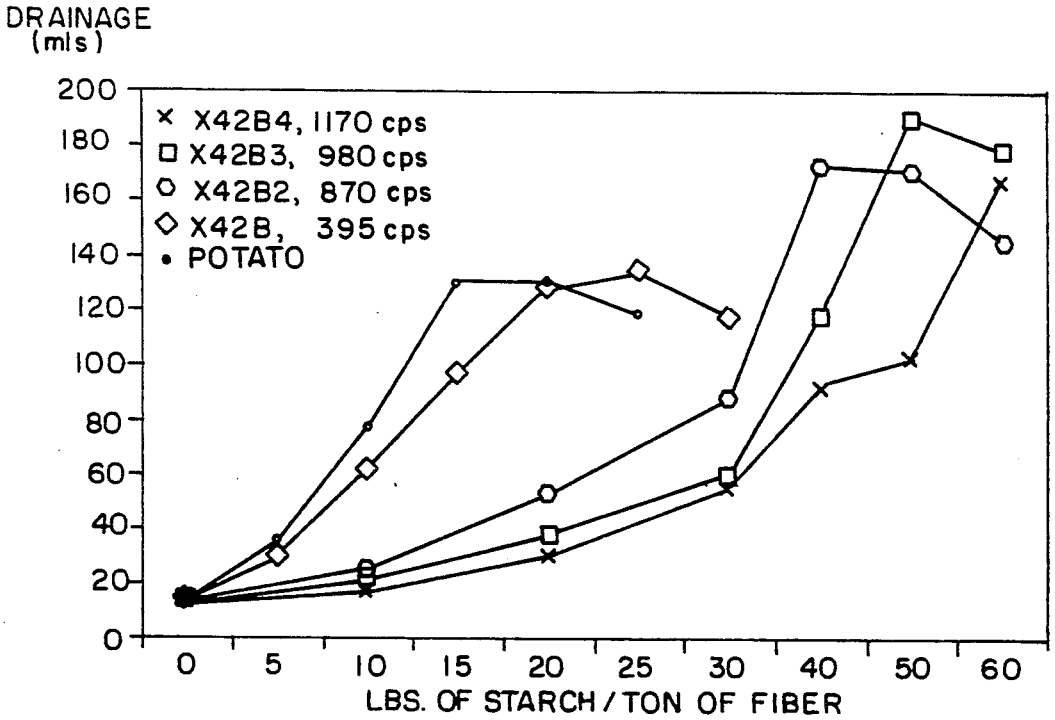
FIGS. 6–9 show the effect of cationic crosslinked starch on drainage of mill furnishes.
Figure 7:
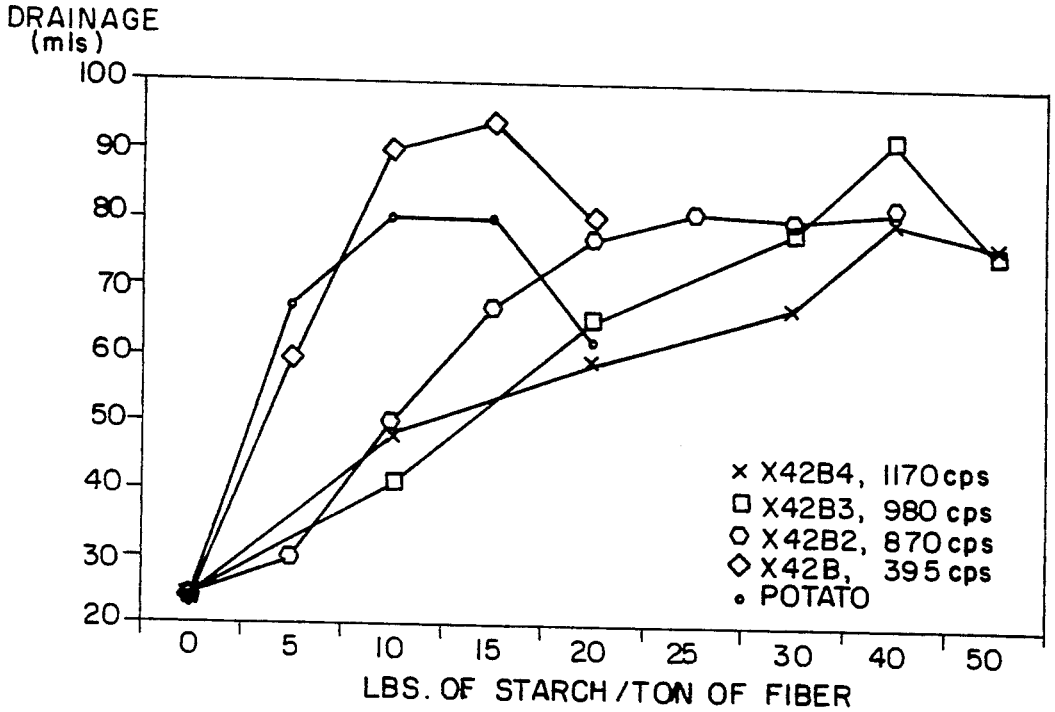
Figure 8:
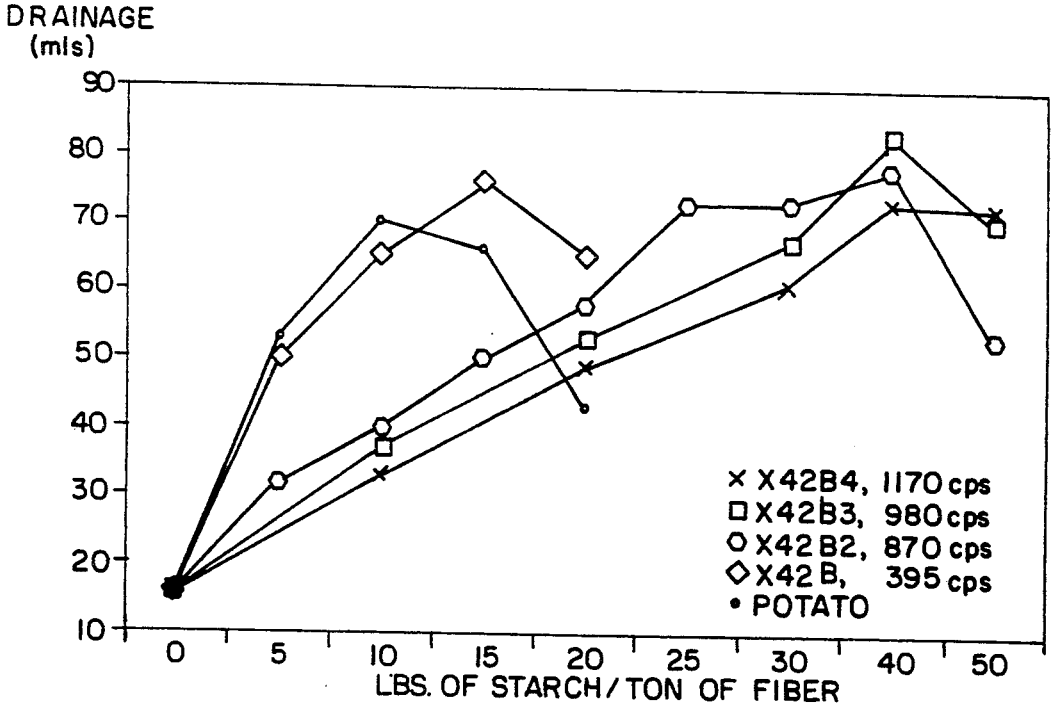
Figure 9:
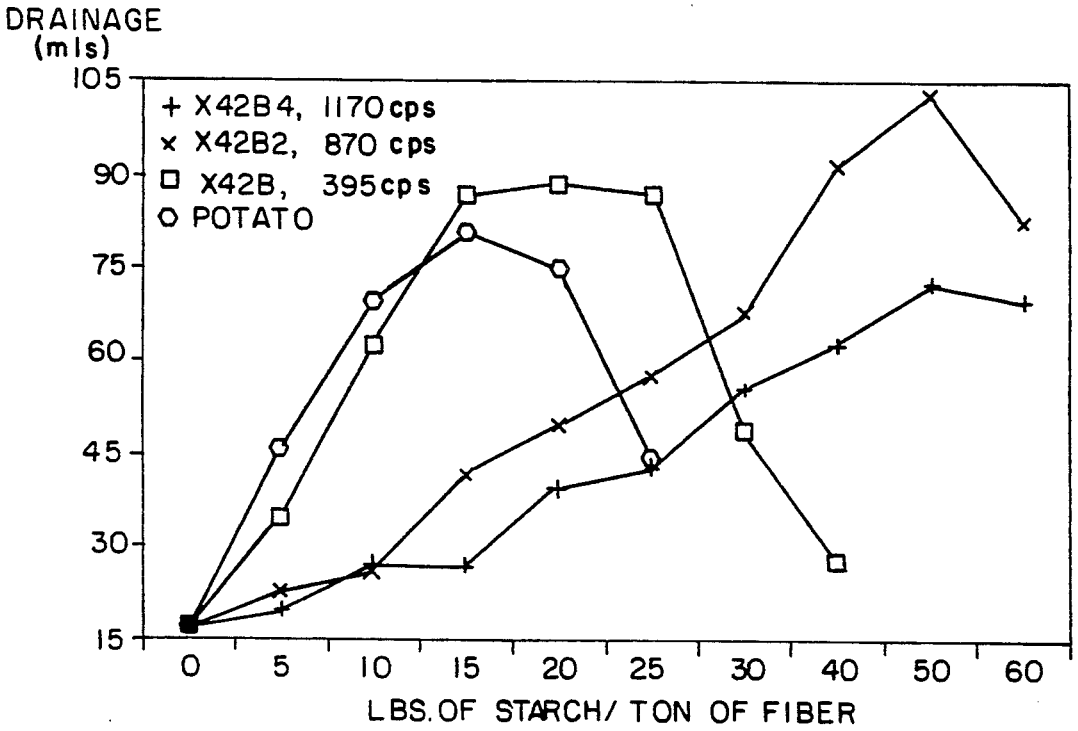

Due to the inherently higher molecular weight of the waxy maize and potato starches, the cross-linking reaction was significantly different than in the cornstarch counterpart. The resulting products did however demonstrate the same drainage trends as can be seen in FIGS. 3 and 4, with increasing peak drainages and starch loading correlating very well with the extent of the cross-linking reaction. FIG. 5 is a comparison study of the best of each of the three starches, evaluating peak drainage and starch loading.

EXAMPLE V (Comparison of Mill Furnishes Using Cationic Cross-linked Starch)

Thick stock (about 3% fiber) was obtained from 4 different paper mills that prepare alkaline paper. This thick stock was then prepared for evaluation of drainage (dilution to 0.3% fiber, including any chemical additives present in the Mill furnish), using a series of cross-linked cationic cornstarches (X42, see Example III) for the comparison with the standard cationic potato starch. In all cases (FIGS. 6 to 9), the Mill furnishes confirmed what had been seen in the laboratory prepared furnishes, that synthetically cross-linking a cationic starch dramatically affects the net available charge of the cationic starch, starch loading, and the water releasing ability of the paper furnish (drainage). It is interesting to note that in the laboratory furnishes, cationic cornstarch cross-linked to a viscosity of 1170 cps (hereinafter known as X42B4), demonstrated the highest water releasing ability, whereas in all of the Mill furnishes the optimum cross-linked starch in the X42 series is X42B3 (980 cps) which is slightly less cross-linked (X42B2 has a viscosity of 870 cps). Zeta Potential measurements and Colloidal Titrations of the Mill furnishes showed that Mill preparation of the fiber versus a re-pulping laboratory method differs in the amount of anionic sites generated. Additionally, the Mill furnishes tend to have higher levels of fines and fillers than the laboratory furnish, adding to the anionic (charge) nature of the furnish. The difference in reactivity of the X42 series of starches suggest that optimization of the cross-linking level on the cationic starch is necessary for each Mill furnish to obtain maximum enhancements in drainage, retention, and starch loading.

EXAMPLE VI (Comparison of Cross-linked, Then Cationized Starch Versus Cationized Starch Which Then Is Cross-linked)

The following cornstarches were cross-linked with the polyaminepolyepoxide resin to a Brookfield hot paste (95° C.) viscosity as indicated below.

| Cornstarch | Brookfield Viscosity | DS |
|---|---|---|
| X11A | 650 cps | 0.033 |
| X11B | 770 cps | 0.032 |
| X11C | 1000 cps | 0.034 |

Figure 10:
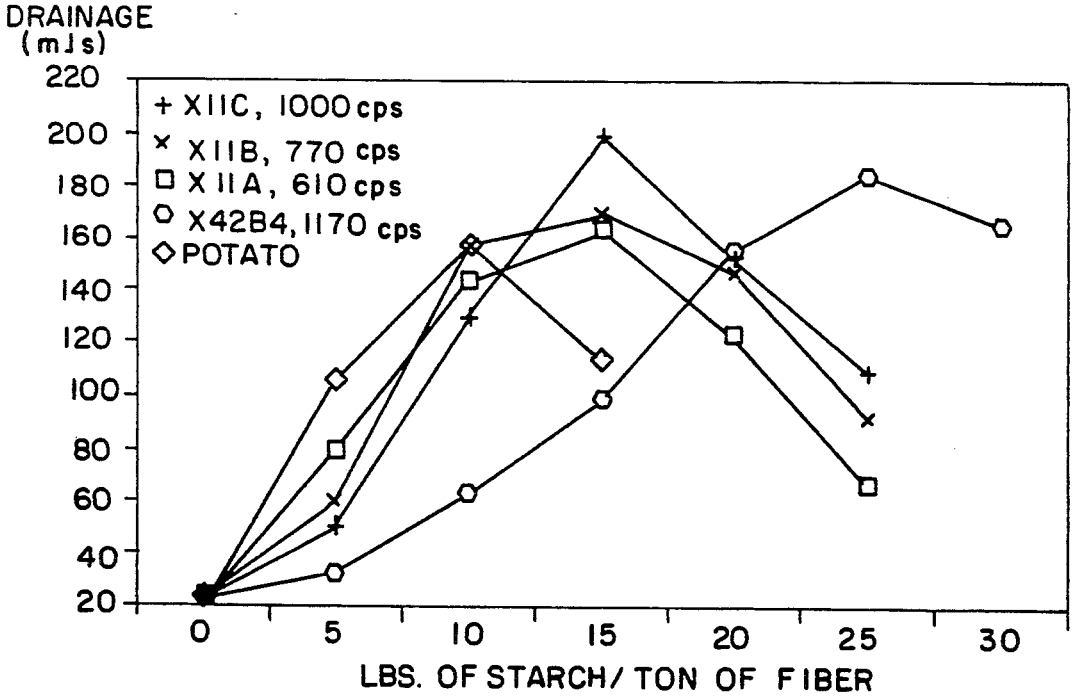
FIG. 10 shows the comparison of crosslinked, then cationized starch versus cationized starch which is then crosslinked.

The above cross-linked starches were cationized after cross-linking by the addition of (3-chloro-2-hydroxypropyl) trimethyl ammonium chloride. The drainage of the latter cross-linked then cationized cornstarches was compared to one of the X42 series of cationic then cross-linked cornstarches (X42B4, 1170 cps), and also the standard cationic potato starch with the results shown in FIG. 10. These results demonstrate that in the X11 series, the correlation between increase in viscosity and increased peak drainage remains as in the X42 series (cationic, then cross-linked), absent however is the shift to higher starch loadings as the viscosity increases as in the X42 series. This phenomenon evidences that cations are enclosed in the cationic then cross-linked process, whereas in the cross-linked then cationized starches this enclosure is to a much lesser degree.

EXAMPLE VII

(Miami University Pilot Paper Machine Trial For Strength Evaluation)

A pilot paper machine trial was performed at Miami University, Oxford, Ohio. A furnish consisting of a 50:50 blend of bleached Kraft hardwood/softwood, with a Canadian Standard Freeness (CSF) of 410, 10% (200 pounds/ton of fiber) $CaCO_3$, 0.1% (2 pounds/ton of fiber) of AKD size, 0.05% (1 pound/ton of fiber) of a cationic retention aid, all at a headbox consistency of 0.4% solids was prepared as needed and reagents added on a continuous feed basis. The pilot paper machine produced a continuous 12 inch wide roll of paper at a rate of 10 ft./min. Starch additions were made at 0.5%, 1.0%, 1.5% and 3.0% levels (10, 20, 30 and 60 pounds/-ton of fiber respectively), and the machine was run for approximately 1 hour at each level for the various starches tested. Additionally, a blank determination was made with no starch additions (0.0%). A 70 g/m$^2$ basis weight sheet was produced. The starches included in this trial consisted of a cationic potato starch (DS 0.040), a cationic cornstarch: X22B (DS 0.032), a cationic cross-linked cornstarch: X23B (DS 0.032) cross-linked to a 1100 cps level, and a cross-linked then cationized corn starch: X11C (DS 0.032) cross-linked to a 1000 cps level. The strength parameters that were tested include Internal Bond (Scott Bond), Tensile, Fold, and Burst, along with the parameters Porosity and Hercules Size Test (HST). Analysis of Variation (ANOVA) was performed on the above parameters, in addition to Moisture, Ash, Grammage, and Caliper, with respect to the changing starches and levels. It was determined that the Moisture, Grammage and Caliper parameters had a low correlation to the effects of the changing starches and correlation to the effects of the changing starches and their levels, with Ash at a slightly higher correlation coefficient. It was, therefore, assumed that the changes seen in the strength parameters were attributable to the various starches and their levels of addition, calculated at 95% confidence.

Table IV summarizes the results of the paper trial with an average response of the starch across all levels of addition with respect to the blank.

TABLE IV

| Level | Potato | X22B | X23B | X11C |
|---|---|---|---|---|
| | INTERNAL BOND (SCOTT BOND) (Scott Bond Units), Root Mean Square Error (RMSE) = 3.2 | | | |
| 0.0% | 50 | 50 | 50 | 50 |
| 0.5% | 49 | 53 | 64 | 58 |

TABLE IV-continued

| Level | Potato | X22B | X23B | X11C |
|---|---|---|---|---|
| 1.0% | 56 | 64 | 76 | 69 |
| 1.5% | 66 | 68 | 90 | 80 |
| 3.0% | 84 | 73 | 106 | 103 |
| Average Unit Increase Over Blank: | 14 | 14 | 34 | 28 |
| | BURST (Pounds per Square Inch) RMSE = 0.68 | | | |
| 0.0% | 9.9 | 9.9 | 9.9 | 9.9 |
| 0.5% | 10.8 | 10.6 | 12.4 | 11.8 |
| 1.0% | 12.3 | 14.2 | 14.0 | 12.6 |
| 1.5% | 13.3 | 14.4 | 14.6 | 14.0 |
| 3.0% | 16.6 | 15.3 | 15.4 | 14.1 |
| Average Unit Increase Over Blank: | 3.4 | 3.7 | 4.2 | 3.2 |
| | TENSILE (Kg/m$^2$) RMSE = 0.284 | | | |
| 0.0% | 5.15 | 5.15 | 5.15 | 5.15 |
| 0.5% | 5.93 | 5.03 | 5.05 | 4.69 |
| 1.0% | 6.32 | 6.32 | 5.44 | 5.10 |
| 1.5% | 6.26 | 6.20 | 5.92 | 5.57 |
| 3.0% | 6.71 | 7.10 | 5.86 | 5.68 |
| Average Unit Increase Over Blank: | 1.16 | 1.01 | 0.42 | 0.11 |
| | MACHINE DIRECTION FOLD (Number of Folds) RMSE = 1.5 | | | |
| 0.0% | 3 | 3 | 3 | 3 |
| 0.5% | 4 | 4 | 7 | 5 |
| 1.0% | 6 | 8 | 9 | 8 |
| 1.5% | 7 | 9 | 13 | 8 |
| 3.0% | 13 | 9 | 14 | 14 |
| Average Unit Increase Over Blank: | 4 | 4 | 8 | 6 |
| | POROSITY (Cubic Feet per Minute) RMSE = 35.1 | | | |
| 0.0% | 404 | 404 | 404 | 404 |
| 0.5% | 386 | 383 | 345 | 338 |
| 1.0% | 386 | 308 | 351 | 328 |
| 1.5% | 351 | 309 | 346 | 320 |
| 3.0% | 281 | 269 | 267 | 243 |
| Average Unit Increase Over Blank: | −53 | −87 | −77 | −97 |
| | HST (Seconds) RMSE = 19.9 | | | |
| 0.0% | 116 | 116 | 116 | 116 |
| 0.5% | 134 | 137 | 171 | 170 |
| 1.0% | 230 | 243 | 210 | 159 |
| 1.5% | 205 | 253 | 230 | 162 |
| 3.0% | 255 | 227 | 195 | 186 |
| Average Unit Increase Over Blank: | 90 | 99 | 86 | 53 |

Although the invention has been described with regard to its preferred embodiments, it should be understood that various changes and modifications as would be obvious to one having the ordinary skill in this art may be made without departing from the scope of the invention which is set forth in the claims appended hereto.

The various features of this invention which are believed new are set forth in the following claims.

What is claimed is:

1. In a papermaking process having a pH of about 6 or greater, a method to increase starch loading capacity, the method comprising:

adding cationized cross-linked starch to a paper furnish of the process prior to the conversion of the furnish to a dry web wherein the starch is cationized to a degree of substitution on the hydroxyl groups of the starch between about 0.005 and about 0.050 and wherein after the cationization the starch is cross-linked to a hot paste viscosity in the range of from about 500 cps to about 3000 cps as measured on a Brookfield viscometer at about 95° C. using a No. 21 spindle.

2. In a process as recited in claim 1 wherein the cationized cross-linked starch is added into a paper furnish is the process at a level sufficient to provide a Zeta potential of about zero in the furnish.

3. In a process as recited in claim 1 wherein the cationized cross-linked starch is added into a paper furnish in the process to at least about 20 pounds of starch per ton of fiber in the furnish.

4. In a process as recited in claims 1, 2 or 3 wherein the cationized cross-linked starch is cationized to a degree of substitution of between about 0.030 to about 0.040.

5. In a process as recited in claims 1, 2 or 3 wherein the starch is cross-linked with a cross-linker selected from the group consisting of a polyamine polyepoxide resin, 1,4 butanediol diglycidyl ether, phosphorousoxychloride, and mixtures thereof.

6. In a process as recited in claim 1, 2 or 3 wherein the starch is cationized by reacting it with a quaternary ammonium ion.

7. In a process as recited in claim 5 wherein the starch is cationized by reacting it with a quaternary ammonium ion.

8. In a papermaking process having a pH of about 6 or greater, a method to increase starch loading capacity, the method comprising:

adding cationized cross-linked starch to a paper furnish of the process in an amount effective for making Zeta potential of the furnish about zero and wherein the starch is cationized with monovalent cations and has a degree of substitution of monovalent cations on the hydroxyl groups of the starch between about 0.005 and about 0.050 and wherein after cationization the starch is cross-linked to a hot paste viscosity in the range of from about 500 cps to about 3000 cps as measured on a Brookfield viscometer at about 95° C. using a No. 21 spindle.

9. In a process as recited in claim 8 wherein the cross-linked starch is loaded into the paper furnish in the process to at least about 20 pounds of starch per ton of fiber in the furnish.

10. In a process as recited in claims 8 or 9 wherein the cationized cross-linked starch is cationized to a degree of substitution of between about 0.030 to about 0.040.

11. In a process as recited in claims 8 or 9 wherein the starch is cross-linked with a cross-linker selected from the group consisting of a polyamine polyepoxide resin, 1, 4 butanediol diglycidyl ether, phosphorousoxychloride, and mixtures thereof.

12. In a process as recited in claim 10 the starch is cross-linked with a cross-linker selected from the group consisting of a polyamine polyepoxide resin, 1,4 butanediol diglycidyl ether, phosphorousoxychloride, and mixtures thereof.

13. In a process as recited in claims 8 or 9 wherein the starch is cationized by reacting it with a quaternary ammonium ion.

14. In a process as recited in claim 12 wherein the starch is cationized by reacting it with a quaternary ammonium ion.

* * * * *